US007055412B2

(12) United States Patent
Leighton

(10) Patent No.: US 7,055,412 B2
(45) Date of Patent: Jun. 6, 2006

(54) UNIVERSAL GAS VALVE KEY

(75) Inventor: Lisa Leighton, Corona, CA (US)

(73) Assignee: Canterbury Enterprises, Corona, CA (US)

( * ) Notice: Subject to any disclaimer, the term of this patent is extended or adjusted under 35 U.S.C. 154(b) by 0 days.

(21) Appl. No.: 11/210,310

(22) Filed: Aug. 24, 2005

(65) Prior Publication Data

US 2006/0011881 A1 Jan. 19, 2006

Related U.S. Application Data

(63) Continuation of application No. 10/749,263, filed on Dec. 31, 2003, now abandoned.

(51) Int. Cl.
*B25B 13/06* (2006.01)

(52) U.S. Cl. ..... 81/124.4; 81/177.2; D8/29

(58) Field of Classification Search ..... 81/124.4, 81/177.2; D8/29
See application file for complete search history.

(56) References Cited

U.S. PATENT DOCUMENTS

| | | | |
|---|---|---|---|
| 2,054,978 | A | 9/1936 | Hoelscher |
| 3,877,327 | A | 4/1975 | Erm |
| 4,542,666 | A | 9/1985 | White |
| 5,813,296 | A | 9/1998 | Hoff et al. |
| 6,131,604 | A | 10/2000 | Harriss |
| 6,176,160 | B1 | 1/2001 | Ruhlander et al. |
| 6,269,717 | B1 | 8/2001 | Bollinger |

OTHER PUBLICATIONS

Website: www.cjshomedecor.com; shut-off valves. (2 pages), Feb. 13, 2004.
Website: www.stonemfg.com; "Fireplace Gas Keys and Valve Covers" (3 pages), Feb. 13, 2004.

*Primary Examiner*—Debra S Meislin
(74) *Attorney, Agent, or Firm*—Stetina Brunda Garred & Brucker

(57) ABSTRACT

A gas valve key is provided having a handle; a longitudinal shaft attached to one end of the handle; and a socket attached to another end of the shaft. The socket has a plurality of cascaded valve stem receiving cavities formed within the socket. Each of the plurality of receiving cavities has successively reduced dimensions, including a first largest cavity forming an opening on one end of the socket. The plurality of cascaded receiving cavities are adapted to receive a valve stem of differing dimensions.

19 Claims, 2 Drawing Sheets

UNIVERSAL GAS VALVE KEY

CROSS-REFERENCE TO RELATED APPLICATIONS

The present application is a continuation of U.S. patent application Ser. No. 10/749,263 entitled UNIVERSAL GAS VALVE KEY filed Dec. 31, 2003, now abandoned, the entirety of the disclosures of which are expressly incorporated herein by reference.

STATEMENT RE: FEDERALLY SPONSORED RESEARCH/DEVELOPMENT (Not Applicable)

BACKGROUND OF THE INVENTION

1. Field of the Invention

The present invention is related to gas valve keys for gas shut-off valves. In particular, the present invention relates to a gas valve key which has a universal socket adapted to be interfaced with a plurality of gas valve stems of different sizes.

2. Background of the Invention

Many modern fireplaces now utilize gas to provide a flame or use gas to assist in lighting real firewood. Common to both is a source of natural gas which is piped within proximity of the hearth of the fireplace. Typically, the gas source is controlled by a shut-off valve near the fireplace. Downstream of the shut-off valve, accessories such as log lighter burner pipes or air-gas mixing chambers may be installed to condition the flow of gas out into the fireplace and to distribute the gas such that an optimal flame may be burned.

Most gas shut-off valves provide a stem of which a gas valve key is adapted to interface to either open or close the gas shut-off valve. The stem most commonly has a square cross section. The gas valve key normally has a receiving socket which is adapted to receive the stem. The gas valve key typically further includes a shaft attached to one end of the socket. On the other end of the shaft, a handle is formed or attached so that the operator can easily provide the leverage to rotate the key either clockwise or counterclockwise. The length of the shaft may vary depending on the placement of the gas shut-off. For instance, sometimes the shut-off valve may be very close to the wall of which the fireplace is built in, and therefore, a gas valve key with a short shaft may be utilized. Other times, the stem of the shutoff valve is positioned well within the hearth, and therefore, a longer shaft is utilized on the gas valve key.

Due to the nature of the key being separately detached from the gas shut-off valve, the gas valve key can be misplaced, similar to that of any other key. When the key is lost, the owner of the gas fueled system must then obtain a new gas valve key. Such gas valve keys are typically stocked at fireplace accessory stores and/or in some circumstances hardware stores.

A common problem occurs when the person who needs a key finally locates a store which supplies gas keys, realizes after the purchase of a new key or is apprised by an informed fireplace supplies store employee, that there are different sizes of valve stems. Many times the purchaser brings the gas key home and then only when the key is installed onto the stem of the gas shut-off valve, is made aware that they bought the wrong key. Other times, the purchaser is made aware of the dilemma at the store, and has to make a guess as to which size gas valve their system may utilize.

It would be beneficial to provide a gas valve key which universally works on different size stems. If such device could be devised, the purchaser would be relieved of the headaches of inadvertently purchasing the wrong sized key. Moreover, the supplier can save shelf space and simply inventory by using a universal gas valve key, instead of having to stock multiple sets of gas valve keys which are only capable of being used with one specific sized valve stem.

SUMMARY OF THE INVENTION

The present invention overcomes the aforementioned disadvantages by providing a universal gas valve key which is adapted to fit to different sized stems.

According to a first embodiment, a gas valve key is provided comprising a handle; a longitudinal shaft attached to one end the handle; and a socket attached to another end of the shaft. The socket has a plurality of cascaded valve stem receiving cavities formed within the socket. Each of the plurality of receiving cavities has successively reduced dimensions, including a first largest cavity forming an opening on one end of the socket, wherein each of the plurality of cascaded receiving cavities is adapted to receive a valve stem of differing dimensions. According to another aspect of the first embodiment of the present invention, the plurality of cascaded receiving cavities includes the first cavity being adapted to receive a 5/16 inch valve stem, and a second cavity adapted to receive a ¼ inch valve stem.

According to another aspect of the first embodiment of the present invention, a universal gas valve key is provided for opening and closing a gas shut-off valve affiliated with a gas fireplace system wherein the gas shut-off valve has a valve stem with a square cross-section for operating the gas shut-off valve. The gas valve key is to be removably attached to the valve stem. The gas valve key may include a generally elliptical-shaped handle having a planar profile with opposing sides and a peripheral edge defining the elliptical shape. A longitudinal shaft is provided defining a first axis and having opposing shaft ends. One shaft end is integrally formed to the peripheral edge of the handle such that the elliptical-shaped handle is generally transversely oriented and centered with respect the first axis. A cylindrically-shaped socket defining a second axis is provided having a pair of circular ends, with one circular end being integrally formed to the other shaft end of the shaft such that the second axis is coincident with the first axis defined by the shaft. The socket has a plurality of cascaded stem receiving cavities formed within a body of said socket, wherein each of the plurality receiving cavities has successively reduced dimensions, a first largest cavity forming an opening on the other circular end of the socket, each of the plurality of cascaded receiving cavities adapted to receive a valve stem of differing dimensions. When the socket of the valve key is positioned over the valve stem, one of the plurality of cascaded stem receiving cavities closely receives the valve stem with a minimal looseness tolerance such that when the handle is turned about the first axis defined by the shaft, the gas valve key imparts one of a clockwise or counterclockwise rotational motion and torqued force to the valve stem to one of close or open the gas shut-off valve affiliated with the gas fireplace system. Furthermore, according to another aspect of the second embodiment, the plurality of cascaded stem receiving cavities including the first cavity adapted to receive a 5/16 inch valve stem, and a second cavity adapted to receive a 1/4 inch valve stem.

According to a second embodiment of the present invention, a gas valve key is provided. The gas valve key includes a handle piece comprising a handle portion, and a handle socket portion integrally formed to the handle portion, and having a first shaft receiving cavity disposed therein forming an opening on one end of the handle socket portion. A longitudinal shaft is provided defining a center axis and having opposing ends, one end force fit into the first receiving cavity of the handle socket portion to form a rigid interconnection between the handle piece and the longitudinal shaft. A second cylindrically-shaped socket is provided defining a second axis and having a pair of circular ends, one end having a second shaft receiving cavity disposed within a body of the second socket therein forming an opening. The other shaft end of the shaft is force fit into the second receiving cavity of the second socket to form a rigid interconnection between the shaft and second socket such that the second axis is coincident with the first axis. The other circular end of the second socket has a plurality of cascaded stem receiving cavities formed within the body of the second socket, wherein each of the stem receiving cavities has successively reduced dimensions, including a first largest cavity forming an opening on the other circular end of the second socket, each of the plurality of cascaded stem receiving cavities adapted to receive a valve stem of differing dimensions. According to another aspect of the second embodiment of the present invention, the plurality of cascaded stem receiving cavities include the first cavity adapted to receive a 5/16 inch valve stem, and a second cavity adapted to receive a 1/4 inch valve stem.

According to another aspect of the second embodiment of the present invention, a universal gas valve key for opening and closing a gas shut-off valve affiliated with a gas fireplace system is provided. The gas shut-off valve has a valve stem with a square cross-section for operating the gas shut-off valve. The gas valve key is adapted to be removably attached to the valve stem. The gas valve key may comprise a handle piece comprising, a generally elliptical-shaped handle portion having a planar profile with opposing sides and a peripheral edge defining the elliptical shape. A handle socket portion is provided having a cylindrical shape defining a first axis and a pair of circular ends. One end is integrally formed to the peripheral edge of the handle such that the elliptical-shaped handle is generally transversely oriented and centered with respect the first axis. The other circular end has a first shaft receiving cavity having a square cross-section disposed therein forming an opening on the other circular end of said socket portion. A longitudinal shaft is provided having a square cross-section defining a second axis and having opposing ends, wherein one end is force fit into the first receiving cavity of the handle socket portion to form a rigid interconnection between the handle piece and the longitudinal shaft such that the first axis of the handle socket portion and second axis of said shaft are coincident. A second cylindrically-shaped socket is further provided defining a third axis and having a pair of circular ends. One end has a second shaft receiving cavity having a square cross-section disposed within a body of the second socket therein forming an opening on the end of the second socket. The other end of the longitudinal shaft is force fit into the second receiving cavity of the second socket to form a rigid interconnection between the shaft and second socket such that the second axis of the shaft is coincident with the third axis of the second socket. The other end of the second socket has a plurality of cascaded stem receiving cavities formed within the body of the second socket, wherein each of the stem receiving cavities has successively reduced dimensions, including a first largest cavity forming an opening on the other circular end of the second socket, and wherein each of the plurality of cascaded stem receiving cavities is adapted to receive a valve stem of differing dimensions. When the second socket of the valve key is positioned over the valve stem, one of the plurality of cascaded stem receiving cavities closely receives the valve stem with a minimal looseness tolerance such that when the handle piece is turned about the second axis defined by the shaft, the gas valve key imparts one of a clockwise or counterclockwise rotational motion and torqued force to the valve stem to one of close or open the gas shut-off valve affiliated with the gas fireplace system. According to another aspect of the present invention, the plurality of cascaded stem receiving cavities include the first cavity adapted to receive a 5/16 inch valve stem, and a second cavity adapted to receive a 1/4 inch valve stem.

Other exemplary embodiments and advantages of the present invention may be ascertained by reviewing the present disclosure and the accompanying drawings.

BRIEF DESCRIPTION OF THE DRAWINGS

The present invention is further described in the detailed description that follows, by reference to the noted drawings by way of non-limiting examples of preferred embodiments of the present invention, in which like reference numerals represent similar parts throughout several views of the drawings, and in which.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

DESCRIPTION OF FIRST EXEMPLARY EMBODIMENT

Figure 1:
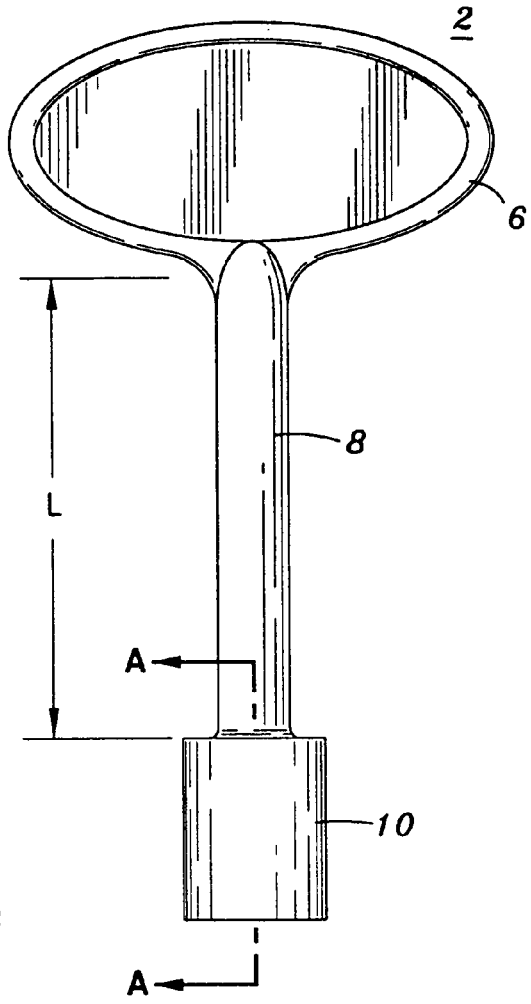
FIG. 1 depicts a first exemplary embodiment of the universal gas valve key.
Figure 3:
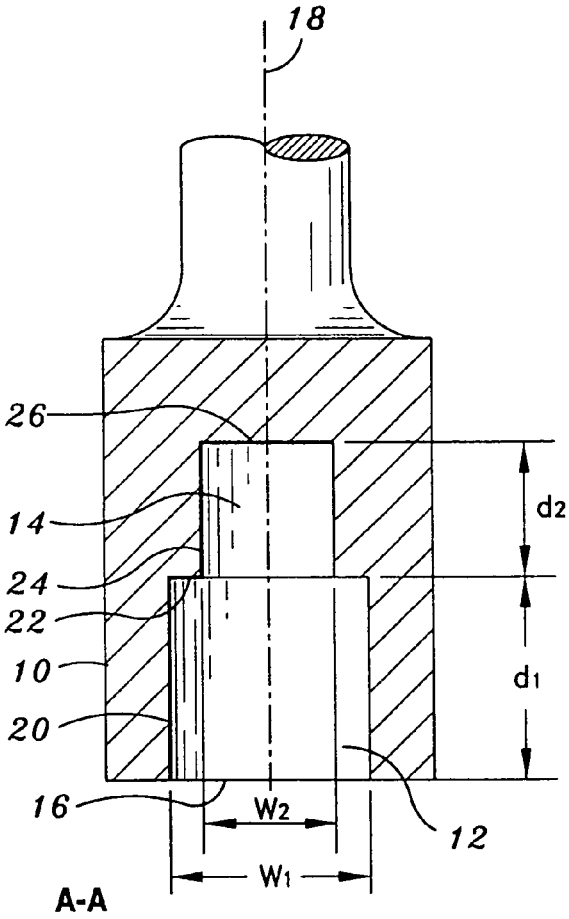
FIG. 3 is a cross-sectional view of the socket portion of the first exemplary embodiment of the universal gas valve key taken along section line A—A from FIG. 2.
Figure 2:
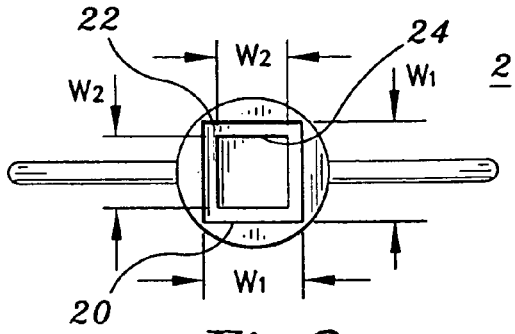
FIG. 2 is a view which looks directly inside the socket of the first exemplary embodiment of the universal gas valve key.

FIGS. 1–3 illustrate a first exemplary embodiment of a universal gas valve key. The first embodiment is a unitarily formed universal gas key 2. The unitarily formed gas key 2 is preferably formed from metal in one of a die-casting process, forging process, or any other well known metal forming process in the art of tool manufacturing.

Gas valve key 2 is composed of three basic components including a handle 6, shaft 8, and receiving socket 10. The handle 6 may be of any shape or form of which is easily grasped and of which provides sufficient leverage to assist in turning the gas shut-off valve stem closed (clockwise) or open (counterclockwise). In the preferred embodiment of the first exemplary embodiment, the handle 6 is a flat elliptical or oval shaped element which is unitarily formed and attached to a distal end of the shaft 8.

The shaft 8 is unitarily formed to and both the handle 6 and the receiving socket 10. The shaft 8 may be any desired length L. Furthermore, the shaft 8 may have a variety of cross sectional shapes, such as circular, square or any other cross sectional shape known in the art of tool manufacturing.

The receiving socket 10 is unitarily formed to a distal end of the shaft 8 such that the axis defined by the socket is coincident with the axis defined by the shaft 8. FIG. 3 is a cross-sectional view of the socket 10 portion of the first exemplary embodiment of the universal gas valve key 2 taken along section line A—A from FIG. 2. So that the gas valve key 2 may universally fit valve stems of varying sizes, a nested or cascaded arrangement of a plurality of square-shaped receiving cavities are formed within the body of socket 10. In particular, a first cavity 12 having a square cross-section with sides having a width $W_1$ is provided in a most outward portion of the body of the socket 10 and is centered about axis 18. Further recessed within the body of the socket 10, is a second cavity having a square cross-section with sides having a width $W_2$. Thus, the contiguous positioning of the first cavity 12 and the second cavity 14 forms one continuous cavity having stepped sides. In particular, a first set of sides 20 having a length or depth of $d_1$ are internally formed in the body of socket 10 in a substantially parallel relationship to center axis 18. At the position where the first set of stepped sides 20 terminates, a set of stepped shoulder sides 22 are provided in normal or perpendicular orientation to the first set of stepped sides 20 and to center axis 18. Next, the second set of stepped sides 24 having a length or depth of $d_2$ are formed which are also in a substantially parallel relationship to center axis 18 are internally formed in the body of socket 10 in a substantially parallel relationship to center axis 18. The second cavity 14 is further defined by a backing side 26 which intersects the most inward ends of the second set of stepped sides and the center axis 18 in a substantially normal or perpendicular orientation.

DESCRIPTION OF SECOND EXEMPLARY EMBODIMENT

Figure 4:
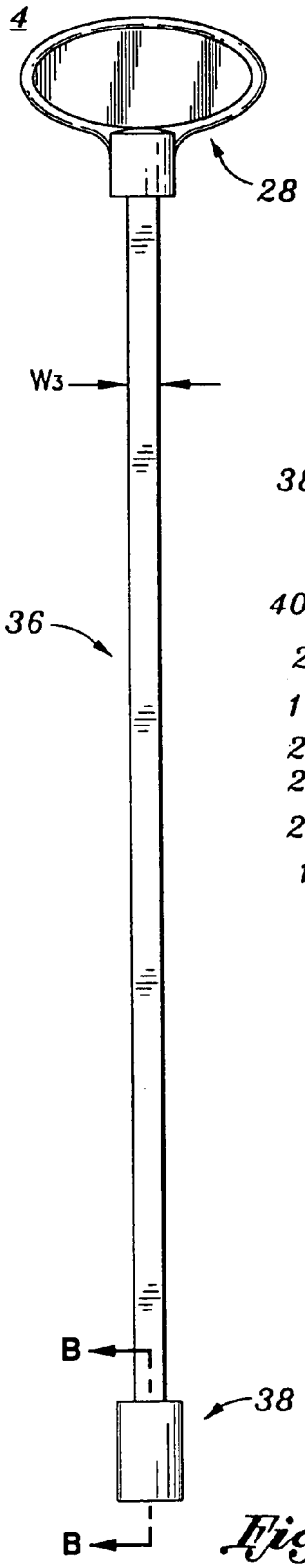
FIG. 4 depicts a second exemplary embodiment of the universal gas valve key.
Figure 6:
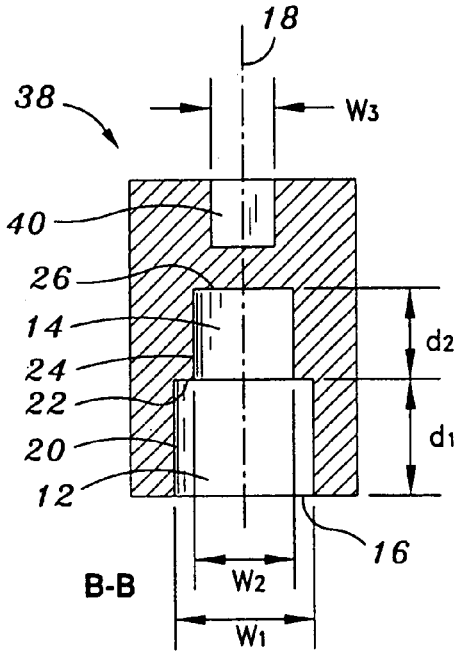
FIG. 6 is a cross-sectional view of the socket portion of the second exemplary embodiment of the universal gas valve key taken along section line B—B from FIG. 2.
Figure 5:
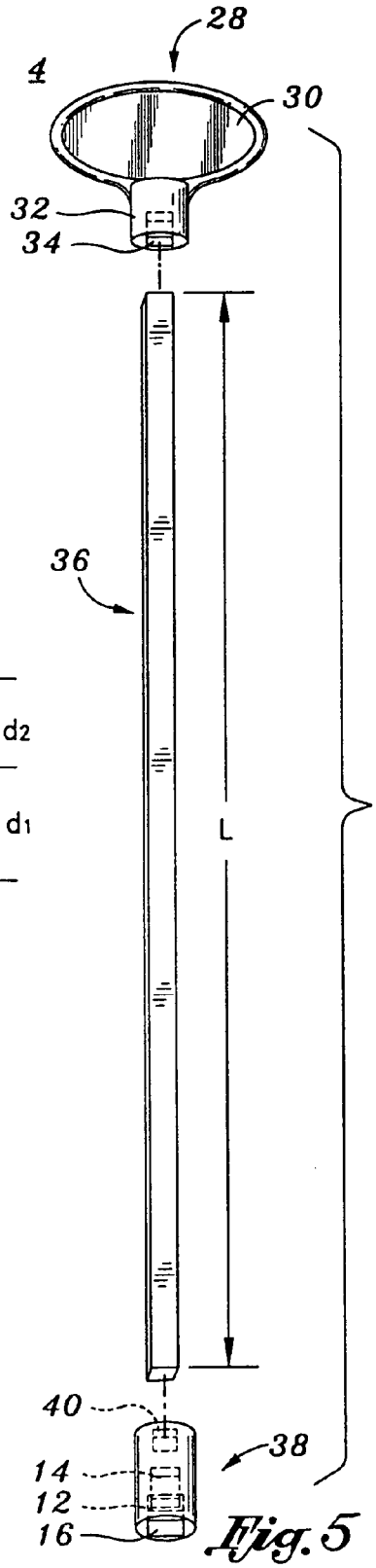
FIG. 5 is an exploded view of the second exemplary embodiment of the universal gas valve key.

FIGS. 4–6 illustrate a second exemplary embodiment of a universal gas valve key 4. The universsal gas key assembly 4 is preferably assembled with several components, as compared to being unitarily formed. All the components of the gas key assembly 4 are preferable made from metal and are formed in one of a die-casting, forging process, extrusion process, and/or any other well-known metal forming process well known in the at of tool manufacturing.

Gas valve key assembly 4 is composed of three separate components including a handle piece 28, shaft piece 36, and socket 38. The handle piece 28 is composed of two portions which are unitarily formed together, including handle portion 30 and handle socket portion 32. The handle portion 30 may be of any shape or form of which is easily grasped and of which provides sufficient leverage to assist in turning the gas shut-off valve stem closed (clockwise) or open (counterclockwise). In the preferred embodiment of the first exemplary embodiment, the handle portion 30 is a flat elliptical or oval-shaped element which is unitarily formed and attached to the handle socket portion 32. The handle socket portion 32 is cylindrically-shaped and provides a first shaft receiving cavity 34 positioned in about the center axis of the cylindrical body and having a cross-section that conforms to the cross-section of the shaft piece 36 such that a distal end of the shaft piece 36 may be force fit into the first shaft receiving cavity.

The shaft piece 36 is separately formed and may be any desired length L. Furthermore, the shaft piece 36 may have a variety of cross-sectional shapes, such as circular, square or any other cross sectional shape known in the art of tool manufacturing for forming durable shafts.

The socket 38 is separately formed and has a cylindrical shape similar to that of a conventional socket. FIG. 6 is a cross-sectional view of the socket 38 of the second exemplary embodiment of the gas valve key assembly 4 taken along section line B—B from FIG. 4. Socket 38 is very similar to the socket 10 from the first embodiment, and therefore, only the differences between the two sockets are discussed. Besides being separately formed, another difference between the socket 38 from the second embodiment 4 and the socket 10 from the first embodiment 2, is that socket 38 has a second shaft receiving cavity 40 on the opposite side of the socket 38 from the first and second cavities 12, 14. The second shaft receiving cavity 40 is similar to the first shaft receiving cavity 34 from the handle piece 28. In particular, the second shaft receiving cavity 40 is positioned about the center axis of the cylindrical body of socket 38 and has a cross-section that conforms to the cross-section of the shaft piece 36 such that the other distal end of the shaft piece 36 may be force fit into the second shaft receiving cavity 40.

It is noted that the preferred embodiment of the present invention provides a first cavity 12 which is adapted to closely interface/interfit to a 5/16 inch valve stem and the second cavity 14 is adapted to closely interface/interfit to a ¼ inch valve stem. Thus, the dimension of widths $W_1$ should slightly exceed 5/16 inch and the dimension of $W_2$ should slightly exceed ¼ inch. It is further appreciated that the gas valve key 2, 4 may be designed such that it fits other sizes of valve stems besides the aforementioned.

Moreover, other embodiments of the gas valve key 2, 4 may include a plurality (i.e., greater than two) of nested cavities adapted to fit a series of incrementally increasing/decreasing sizes of valves stems. Furthermore, it is appreciated that, the cross-sectional shape of the valve stem may have a shaped other than a square, such as a hexagon. Therefore, other universal gas valve key embodiments may be provided which include numerous permutations and/or combinations of a numbers of nested cavities which are adapted to fit various shapes of valve stems if so required, and having various shaft lengths L.

Although the invention has been described with reference to several exemplary embodiments, it is understood that the words that have been used are words of description and illustration, rather than words of limitation. Changes may be made within the purview of the appended claims, as presently stated and as amended, without departing from the scope and spirit of the invention in its aspects. Although the invention has been described with reference to particular means, materials and embodiments, the invention is not intended to be limited to the particulars disclosed; rather, the invention extends to all functionally equivalent structures, methods, and uses such are within the scope of the appended claims.

What is claimed:

1. A gas valve key consisting essentially of:

a handle piece including a handle portion and a handle socket portion, the handle socket portion defining a pair of ends, one end being unitarily formed to said handle portion, the other end having a first shaft receiving cavity having a substantially square cross-section disposed therein forming an opening on the other end of said socket portion;

a longitudinal shaft being a solid bar having a substantially square cross-section and defining opposing ends, one end being force fit into said first receiving cavity of said handle socket portion to form a rigid interconnection between said handle piece and said longitudinal shaft; and a second socket defining a pair of ends, one end having a second shaft receiving cavity defining a substantially square cross-section, the second shaft receiving cavity being disposed within a body of said second socket and forming an opening on said one end of said second socket with the other end of said longitudinal shaft being force fit therein to form a rigid interconnection between said longitudinal shaft and said second socket, the other end of said second socket having a plurality of cascaded stem receiving cavities disposed therein and forming an opening on the other end of said second socket, each cascaded stem receiving cavity having a substantially square cross-section formed within said body of said second socket.

2. The gas valve key of claim 1 wherein the handle portion is generally elliptical-shaped and defines a planar profile with opposing sides and a peripheral edge defining the elliptical shape.

3. The gas valve key of claim 2 wherein the handle socket portion defines a first axis and said one end of said handle socket portion is integrally formed to said peripheral edge of said handle portion such that said elliptical-shaped handle portion is generally transversely oriented and centered with respect the first axis.

4. The gas valve key of claim 1 wherein the handle socket portion defines a cylindrical shape.

5. The gas valve key of claim 1 wherein the pair of ends of said handle socket portion are circular.

6. The gas valve key of claim 1 wherein said handle socket portion defines a first axis and said longitudinal shaft defines a second axis, said handle piece and said longitudinal shaft being rigidly interconnected, with said first axis of said handle socket portion being coincident with said second axis of said shaft.

7. The gas valve key of claim 6 wherein said second socket defines a third axis, said shaft and said second socket being rigidly interconnected, with the second axis of said shaft being coincident with said third axis of said second socket.

8. The gas valve key of claim 1 wherein said second socket is cylindrically shaped.

9. The gas valve key of claim 1 wherein said ends of said second socket are circular.

10. The gas valve key of claim 1 wherein said other end of said second socket has only a pair of cascaded stem receiving cavities disposed therein.

11. The gas valve key of claim 10 wherein one of said pair of cascaded stem receiving cavities is a first cavity being adapted to receive a 5/16 inch wide valve stem.

12. The gas valve key of claim 11 wherein one of said pair of cascaded stem receiving cavities is a second cavity being adapted to receive a 1/4 inch wide valve stem.

13. A gas valve key consisting essentially of:

a handle piece including a handle portion and a handle socket portion, the handle socket portion defining a pair of ends, one end being unitarily formed to said handle portion, the other end having a first shaft receiving cavity defining a substantially square cross-section;

a longitudinal shaft defining a substantially square cross-section and opposing ends, the shaft being a solid bar, one end being received into said first shaft receiving cavity of said handle socket portion to form a rigid interconnection between said handle piece and said longitudinal shaft; and a second socket defining a pair of ends, one end having a second shaft receiving cavity defining a substantially square cross-section, the other end of said longitudinal shaft being received therein to form a rigid interconnection between said longitudinal shaft and said second socket, the other end of said second socket having a plurality of cascaded stem receiving cavities disposed therein, each cascaded stem receiving cavity defining a substantially square cross-section formed within said body of said second socket.

14. The gas valve key of claim 13 wherein the handle portion is generally elliptical-shaped and defines a planar profile with opposing sides and a peripheral edge defining the elliptical shape.

15. The gas valve key of claim 13 wherein the handle socket portion defines a first axis and said one end of said handle socket portion is integrally formed to said peripheral edge of said handle portion such that said elliptical-shaped handle portion is generally transversely oriented and centered with respect the first axis.

16. The gas valve key of claim 13 wherein said handle socket portion defines a first axis and said longitudinal shaft defines a second axis, said handle piece and said longitudinal shaft being rigidly interconnected, with said first axis of said handle socket portion being coincident with said second axis of said shaft.

17. The gas valve key of claim 16 wherein said second socket defines a third axis, said shaft and said second socket being rigidly interconnected, with the second axis of said shaft being coincident with said third axis of said second socket.

18. The gas valve key of claim 13 wherein said pair of cascaded stem receiving cavities are first and second cavities, said first cavity being adapted to receive a 5/16 inch wide valve stem, said second cavity being adapted to receive a 1/4 inch wide valve stem.

19. A universal gas valve key for opening and closing a gas shut-off valve affiliated with a gas fireplace system, the gas shut-off valve having a valve stem with a square cross-section measuring either 5/16 inches wide or 1/4 inches wide for operating said gas shut-off valve, said gas valve key adapted to be removably attached to the valve stem, said gas valve key consisting of:

a handle piece including, a generally elliptical-shaped handle portion having a planar profile with opposing sides and a peripheral edge defining the elliptical shape, and a handle socket portion having a cylindrical shape defining a first axis and a pair of circular ends, one end being unitarily formed to said peripheral edge of said handle portion such that said elliptical-shaped handle portion is generally transversely oriented and centered with respect the first axis, and the other circular end having a first shaft receiving cavity having a substantially square cross-section disposed therein forming an opening on the other circular end of said socket portion;

a longitudinal shaft being a solid bar having a substantially square cross-section defining a second axis and having opposing ends, one end force fit into said first receiving cavity of said handle socket portion to form a rigid interconnection between said handle piece and said longitudinal shaft such that the first axis of said handle socket portion and second axis of said shaft are coincident; and a second cylindrically-shaped socket defining a third axis and having a pair of circular ends, one end having a second shaft receiving cavity having a substantially square cross-section disposed within a body of said second socket therein forming an opening on the end of said second socket, the other end of said longitudinal shaft force fit into said second receiving cavity of said second socket to form a rigid interconnection between said shaft and second socket such that the second axis of said shaft is coincident with the third axis of said second socket, and the other end of said second socket having only a pair of cascaded stem receiving cavities disposed therein, each having a substantially square cross-section formed within said body of said second socket, the pair of cascaded stem receiving cavities including a first cavity adapted to receive a 5/16 inch wide valve stem and a second cavity adapted to receive a ¼ inch wide valve stem;

wherein when said second socket of said valve key is positioned over the valve stem, one of the cascaded stem receiving cavities closely receives the valve stem with a minimal looseness tolerance such that when said handle piece is turned about the second axis defined by said shaft, said gas valve key imparts one of a clockwise or counterclockwise rotational motion and torqued force to the valve stem to one of close or open the gas shut-off valve affiliated with the gas fireplace system.

* * * * *